United States Patent [19]

Doyle et al.

[11] Patent Number: 4,523,646

[45] Date of Patent: Jun. 18, 1985

[54] FASTENER DRIVING TOOL

[75] Inventors: Richard H. Doyle, Mt. Prospect; Lee B. Fiori, Melrose Park, both of Ill.

[73] Assignee: Duo-Fast Corporation, Melrose Park, Ill.

[21] Appl. No.: 516,194

[22] Filed: Jul. 22, 1983

Related U.S. Application Data

[63] Continuation of Ser. No. 155,767, Jun. 2, 1980, abandoned.

[51] Int. Cl.[3] ..... B25C 5/13

[52] U.S. Cl. ..... 173/15; 173/115; 227/8; 227/130; 92/12

[58] Field of Search ..... 173/15, 115; 227/8, 227/130; 91/449, 415, 417 A; 92/12

[56] References Cited

U.S. PATENT DOCUMENTS

| | | | |
|---|---|---|---|
| 1,990,052 | 2/1935 | Sosa | 91/449 X |
| 2,980,071 | 4/1961 | Ottestad | 92/12 X |
| 3,580,455 | 5/1971 | Cast et al. | 227/130 X |
| 3,601,007 | 8/1971 | Korth | 227/130 X |
| 3,715,069 | 2/1973 | O'Conner | 227/130 |
| 3,905,535 | 9/1975 | Novak et al. | 227/130 X |
| 4,030,655 | 6/1977 | Rothfuss et al. | 227/130 |

FOREIGN PATENT DOCUMENTS

| | | | |
|---|---|---|---|
| 1936356 | 1/1970 | Fed. Rep. of Germany | 227/130 |
| 1907069 | 10/1970 | Fed. Rep. of Germany | 227/130 |

*Primary Examiner*—Robert R. Mackey

*Attorney, Agent, or Firm*—Mason, Kolehmainen, Rathburn & Wyss

[57] ABSTRACT

A fastener driving tool includes a housing defining a handle portion and a head portion with a nose portion extending therebelow. Mounted within the head portion is a cylindrical sleeve within which is reciprocally mounted a drive piston. A driver for driving fasteners is secured to the drive piston and reciprocates therewith. The tool includes a drive power control for controlling the penetration of the fasteners into a workpiece. The drive power control includes a choke encircling the sleeve to impede the flow of exhaust air from beneath the piston and under the sleeve during a driving stroke. The choke may be moved to a position spaced from the cylindrical sleeve wherein the flow of fluid below the piston is not inhibited. In addition, the tool includes a safety member with a workpiece engaging portion of at least one wear block secured thereto to engage the workpiece and protect the safety member from undue wear.

13 Claims, 7 Drawing Figures

FASTENER DRIVING TOOL

This is a continuation of application Ser. No. 155,767 filed 6/2/80 now abandoned.

BACKGROUND OF THE INVENTION

The device of the present invention relates to a new and improved drive power control system for controlling the penetration of a fastener of a fluid actuated tool into a workpiece.

DESCRIPTION OF THE PRIOR ART

Prior art pneumatic or fluid actuated tools that drive fasteners into workpieces such as asphalt shingles have not been approved for widespread use due to the uncontrolled overdriving of the fasteners into the workpiece. Overdriving can damage the workpiece resulting in poor adhesion to a surface such as roof deck.

One prior art method or attempt to control driver penetration is by control or adjustment of air pressure. This method or attempt has not been completely successful in that in actual practice, it is not always excercised due to the inconvenience of the adjustments necessary and due to the wide variation in air pressure available at the work site. Consequently, complete approval of pneumatic or fluid actuated tools has not been obtained.

Other means of controlling driver penetration has met with considerable difficulties due to the different systems employed for returning the driver of these types of tools after a driving stroke.

An additional problem encountered by prior art tools particularly in the area of securing asphalt shinges to a roofing deck has been the rapid wear of different components such as the workpiece engaging portion of the safety yoke of the tool over short periods of time; thus, resulting in expensive replacement, repair and downtime for service of the tools.

SUMMARY OF THE INVENTION

An object of the present invention is to provide a new and improved tool for driving fasteners into a workpiece.

Another object of the present invention is to provide a new and improved drive power control system for a pneumatic fastener driving tool for controlling fastener penetration into a workpiece.

Another object of the present invention is to provide a new and improved drive power control system for a pneumatically actuated tool wherein the drive stroke of the driver of the tool can be consistently and accurately controlled thereby preventing over driving of fasteners into a workpiece.

A further object of the present invention is to provide a new and improved safety yoke member for a pneumatic tool that will not rapidly wear out due to engagement of the safety yoke with an abrasive workpiece such as an asphalt shingle.

The present invention is directed to a new and improved drive power control system and a long wearing safety yoke that may be utilized on pneumatic or fluid actuated fastener driving tools. Such fastener driving tools include a housing defining a handle portion and a head portion with a nose portion extending below the head portion. The pneumatic tool of the present invention is of the type that includes a cylindrical sleeve reciprocally or movably mounted within the head portion. The lower end of the cylindrical sleeve engages and is thereby sealed by an annular member and a resilient O-ring. The lower end of the sleeve engages the annular member during the return of the driver.

During a drive stroke of the tool, a drive piston and driver mounted within the sleeve move downwardly under the influence of pressurized air. The cylindrical sleeve prior to the driving stroke, is raised slightly creating an open space or air passage between the lower end of the cylindrical sleeve and the O-ring mounted in the annular member. Thus, the exhaust air below the drive piston is allowed to escape to the atmosphere and does not inhibit the downward movement of the drive piston and driver.

The drive control of the present invention includes an annular choke element mounted within the head portion surrounding the cylindrical sleeve and annular member. The choke member may be positioned within the head portion to encircle the gap or passage defined between the lower end of the sleeve and the upper end of the annular member, thus, impeding the flow of exhaust air through this passage and thereby throttling the flow of exhaust air therethrough. In this manner, the power of the tool can be controlled and in the full choke position, reduces the fastener penetration into the workpiece.

In another position, the choke member is moved away from the passage between the lower end of the sleeve and the upper end of the annular member and O-ring allowing free flow of the air beneath the piston and driver during a driving stroke, thus, allowing complete fastener penetration. Between these two positions, intermediate throttling positions may be accomplished.

The tool of the present invention also includes a safety yoke with a workpiece engaging member. To actuate the tool, the tool and the workpiece engagement member must be fully placed upon the workpiece. If the workpiece is highly abrasive such as asphalt shingles, the movement of the tool over the workpiece results in rapid deterioriation or wear of the workpiece engaging portion of the safety yoke necessitating replacement and repair. The tool of the present invention includes multisided wear block members secured to the safety yoke and extending below the nose portion of the tool so as to protect both the safety yoke and the lower end of the nose portion from wear thereby allowing long term use of the tool without replacement or repair of worn parts.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DETAILED DESCRIPTION OF A PREFERRED EMBODIMENT

The present invention is primarily directed to a drive power control system for a pneumatically actuated tool and wear blocks for the safety yoke of those tools. The particular construction and structural features of the tool itself are not essential to the invention. Accordingly, only general reference will be made to the tool. For a more detailed description of the tool of the type that may employ the principles of the present invention, reference may be made to U.S. Pat. No. 3,905,535 wherein a more detailed description is provided.

Figure 1:
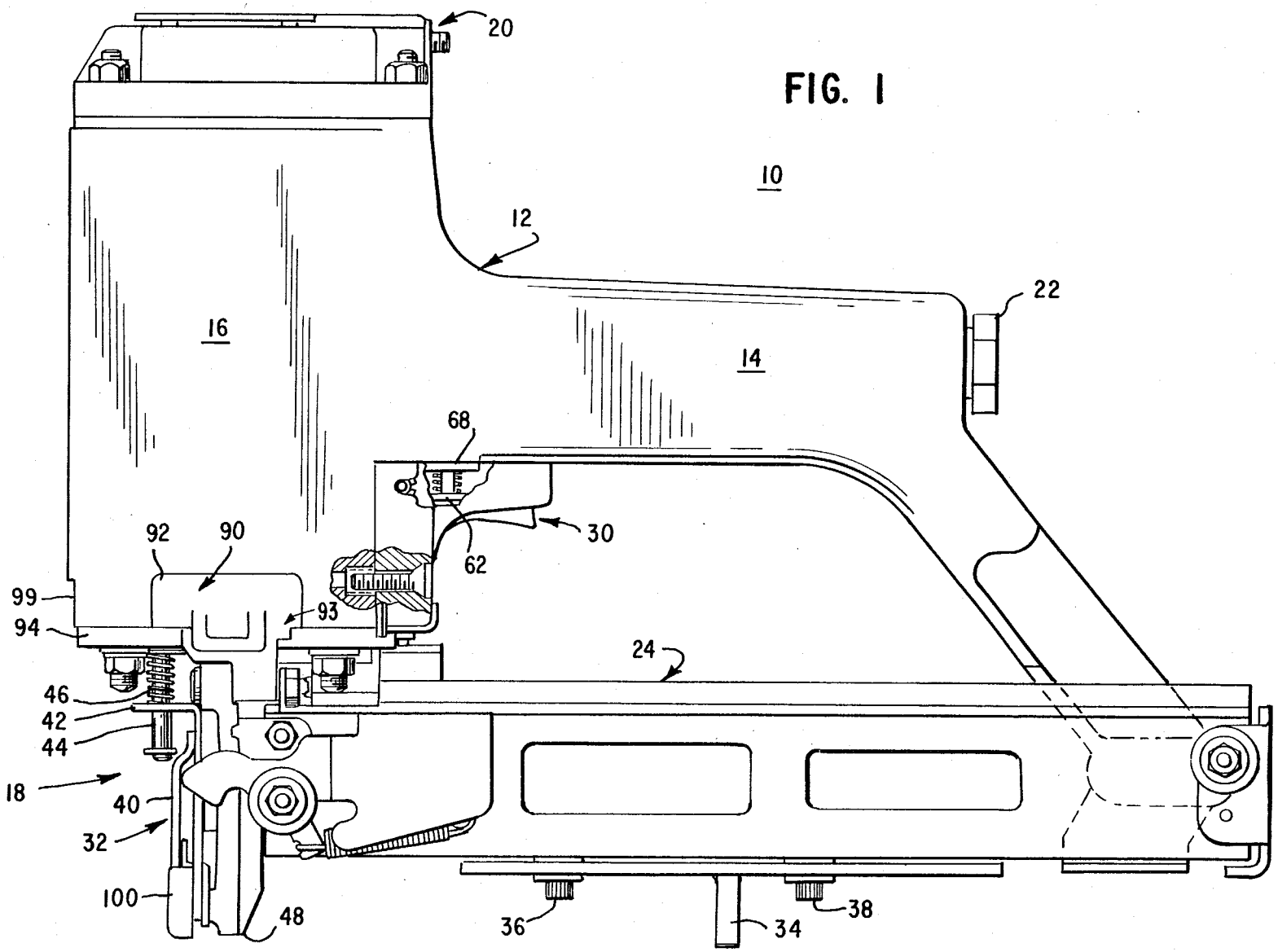
FIG. 1 is a partially cut-away view of a tool constructed in accordance with the principles of the present invention.

Referring now to the drawings and initially to FIG. 1, a pneumatically actuated tool 10 is illustrated. The tool 10 includes a housing generally designated by the reference numeral 12 that defines a handle portion 14 and a head portion 16. Secured to and extending below the head portion 16 is a nose assembly generally designated by the reference numeral 18 and secured to the upper end of the head portion 16 is a cap assembly generally designated by the reference numeral 20. The handle portion 14 defines a reservoir that is connected by a hexagonal bushing 22 to a source of pressurized pneumatic fluid.

The tool 10 is intended to drive fasteners and in accordance with the invention described, the fasteners may be staples for attaching shingles to a roof deck. The fasteners or staples are contained within a magazine assembly generally designated by the reference numeral 24 secured at a rear end thereof to the handle portion 14. The magazine assembly 24 is also mounted at the forward end to the depending nose portion 18. Actuation of the tool will be described more fully hereinafter; however, manual actuation is accomplished by actuation of a trigger assembly generally designated by the reference numeral 30. Prior to actuation of the trigger assembly 30, however, the tool 10 must be placed onto a workpiece such as a shingle and a safety yoke assembly 32 must engage the workpiece. If the safety yoke assembly 32 is not so engaged, actuation of the trigger 30 is prevented.

As will also be discussed further hereinafter, the tool 10 and its components are subject to substantial wear due to abrasion from the surfaces of the shingle on which the tool 10 is placed. Accordingly, a guide 34 of hardened material is secured by screws 36 and 38 to the magazine assembly 24 to provide both the function of aligning the tool 10 on a workpiece such as a roof deck and to protect the magazine assembly 24 from undue wear caused by abrasion from the shingles.

Figure 2:
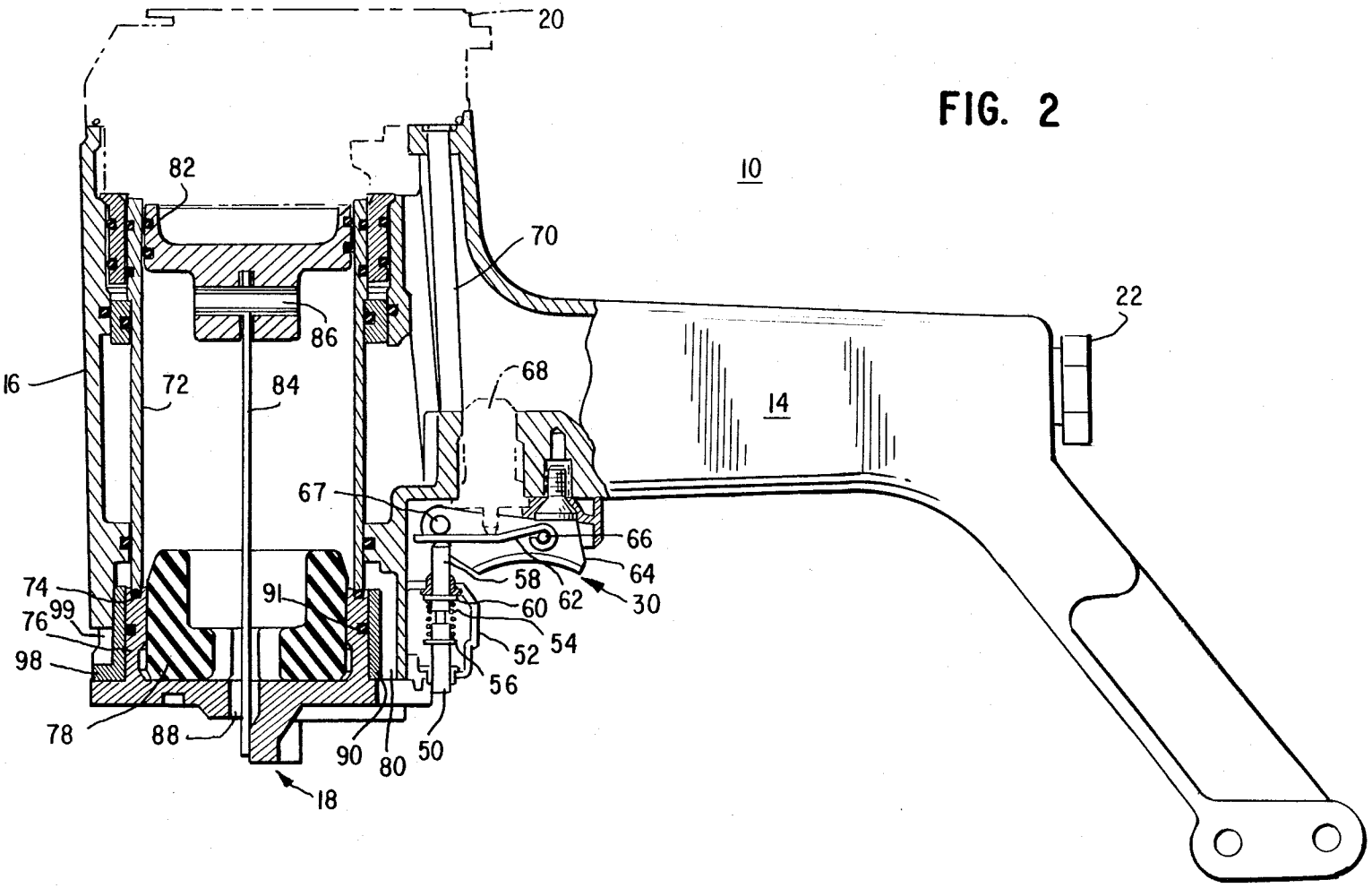
FIG. 2 is a vertical cross-sectional view of the head portion of the tool of the present invention.

Referring briefly to FIGS. 1 and 2, a description of how the tool 10 may be energized to drive a staple wil be provided. As will be noted in FIG. 2, the cap assembly 20 is only shown in phantom since it is fully described in U.S. Pat. No. 3,905,535. FIG. 2 does illustrate a sufficient portion of the tool 10 to describe the operation thereof. More specifically, the safety assembly 32 (FIG. 1) includes a safety yoke 40 with a horizontal extension 42 that includes an aperture through which extends a pin 44 that is secured to the nose portion 18. A spring 46 surrounds the pin 44 and biases the horizontal extension 42 and the safety yoke 40 downward to allow the lower end of the safety yoke 40 to extend below the lower end 48 of the nose portion 18. As can be seen in FIG. 1, upon placement of the tool 10 onto a workpiece, the spring 46 is compressed.

Figure 5:
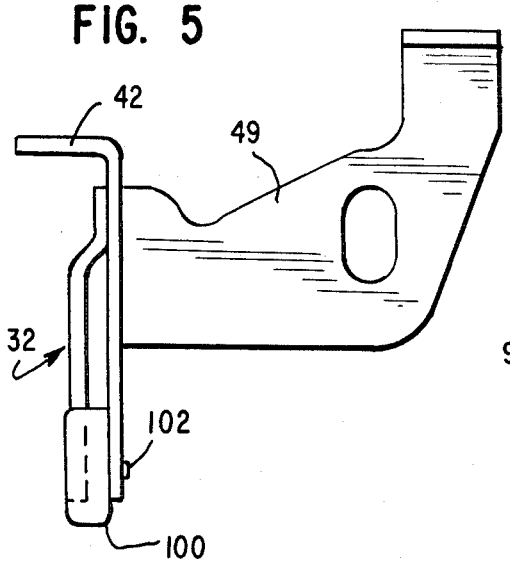
FIG. 5 is an enlarged side view of the safety yoke of the present invention.

The safety yoke assembly 18 also includes a mechanical connection to the trigger assembly 30 by way of an arm 49 (FIG. 5). More specifically, the arm 49 is mechanically connected to a safety pin 50 (FIG. 2) that is slideably mounted within a housing 52. The pin 50 includes a lost motion connection including a spring 54 encircling the pin 52 held in position by an E-ring 56. The spring 54 also encircles a second pin 58 and is held thereon by a E-ring 60. The second pin 58 extends upward out of the housing 52 to engage a trip lever 62 that is pivotally mounted on a trigger member 64 by a pin 66. The trigger member 64 is also pivotally mounted on the tool 10 by a pin 67.

The trip lever 62 engages a valve 68 shown in phantom lines in FIG. 2 that upon being actuated by the trip lever 62, vents conduit 70 to atmosphere. The conduit 70 communicates with the cap assembly 20 and a poppet valve therein such that venting of conduit 70 allows a cylindrical sleeve 72 reciprocally mounted within the head portion 16 to lift upwardly out of engagement with an O-ring 74 secured within an annular retainer member 76 that functions to retain a bumper 78 and define a nose plate 94. Upon lifting of the cylindrical sleeve 72 upward, a flow path from within the cylindrical sleeve 72 to the atmosphere through a passage 80 is defined.

Simultaneously with lifting of the cylindrical sleeve 72, pressurized air is introduced above a drive piston 82 that is reciprocally mounted within the cylindrical sleeve 72 to drive the drive piston 82 downward during a drive stroke of the tool 10. A driver blade 84 is secured to the driver piston 82 by a pin 86 and is driven downward through a race or drive track 88 defined in the depending nose portion 18 to engage a fastener to drive it into a workpiece.

At the completion of the downward movement of the piston 82 and completion of the drive stroke, the piston 82 engages the bumper 78. Thereafter, the cylindrical sleeve 72 is moved downwardly to engage the O-ring 74 and pressurized fluid is introduced within the cylindrical sleeve 72 below the piston 82 to return the piston 82 and the driver 84 to the static position (FIG. 2).

Figure 3:
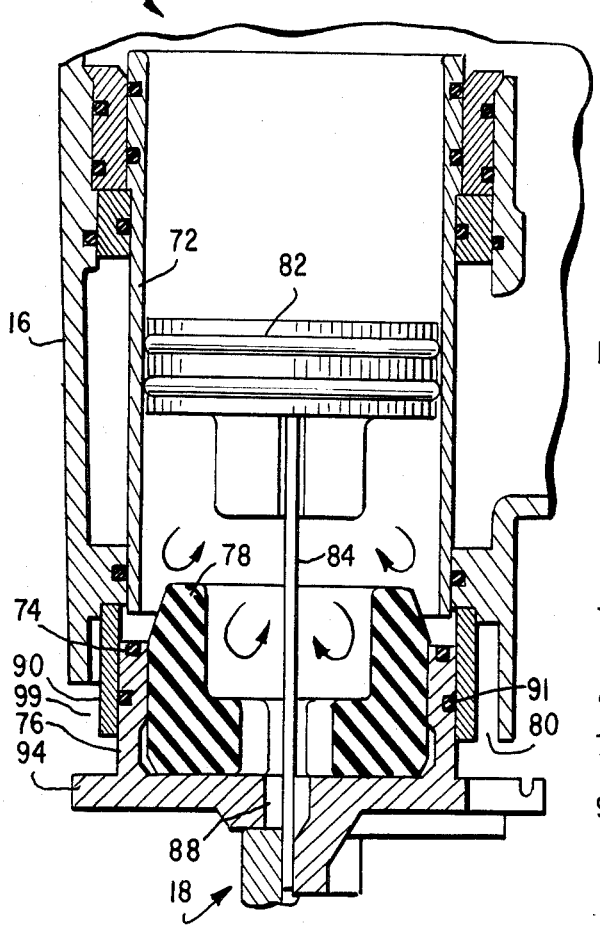
FIG. 3 is a cross-sectional, schematic illustration of the choke of the present invention in the full choke position.
Figure 4:
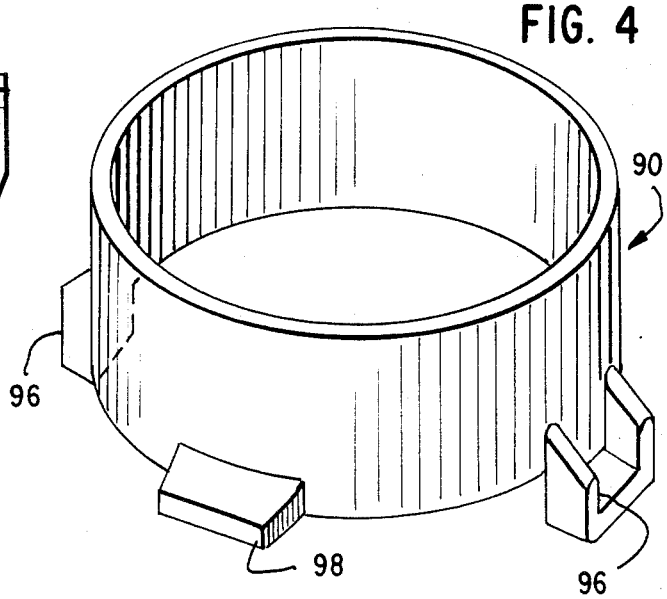
FIG. 4 is an enlarged perspective view of the choke of the present invention.
Figure 7:
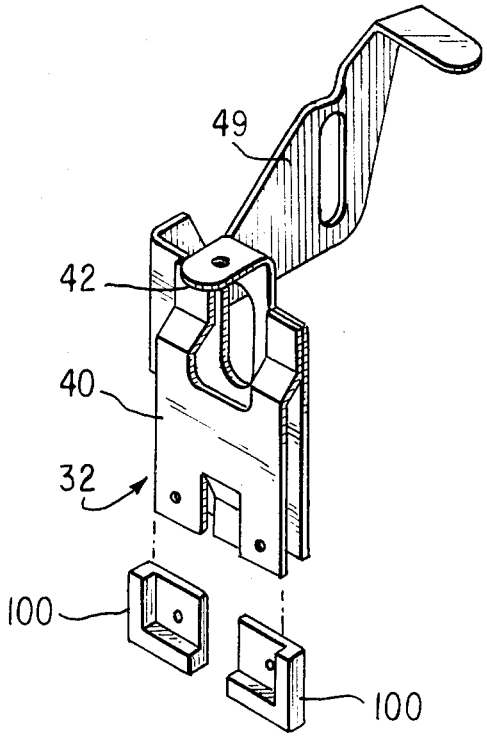
FIG. 7 is a perspective view of the wear blocks and safety yoke of the present invention.

In the typical prior art tools of the type such as tool 10, there has occurred uncontrolled over driving of staples or fasteners into the workpiece such as a shingle, resulting in damage and poor adhesion of the shingle to the roof deck. Accordingly, it is desirable that a convenient, simple, inexpensive procedure be available to control penetration of the fastener blade 84. In accordance with the principles of the present invention, driver penetration control is accomplished through the use of a choke generally designated by the reference numeral 90 (FIG. 4). With specific reference to FIGS. 1 and 2, the position of the choke member 90 within the head portion 16 is illustrated. With reference first to FIG. 2, the choke member 90 as illustrated is of an annular configuration and is mounted within the head portion 16 to encircle the retainer member 76 below the O-ring 74 and the lower end of the cylindrical sleeve 72. The choke 90 is specifically mounted within the passage 80 and is of a dimension to allow the choke member 90 to be moved upwardly to completely surround the interface between the lower end of the cylindrical sleeve 72 and the O-ring 74 and form a seal at a second O-ring 91 mounted in the retainer 76, this latter position corresponds to the full choke position (FIG. 3). In the other extreme, the choke 90 may be moved to a position surrounding the annular retainer 76 spaced from the interface of the lower end of the cylindrical sleeve 72 and the O-ring 74.

In effect, in the full choke position wherein the choke 90 completely encircles or surrounds the interface between the cylindrical sleeve 72 and the O-ring 74, the passage 80 is blocked, thus preventing the free flow of pressurized fluid between the O-ring 74 and the lower end of the cylindrical sleeve 72 during a driving stroke of the tool 10, thus inhibiting the flow of air beneath the piston 82 during the drive stroke. In the full choke position, air below the piston 82 does leak out around the driver blade 84 but at a reduced rate of flow.

Figure 6:
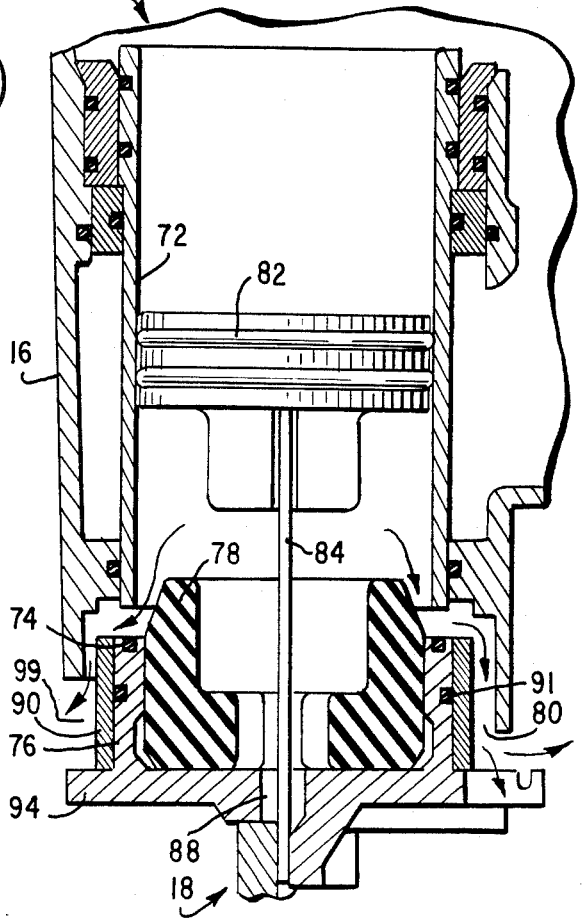
FIG. 6 is a view similar to FIG. 3 with a choke in the full open or non-choke position.

In the non-choke position, the choke 90 is in the position illustrated in FIGS. 2 and 6 wherein the passage 80 is open allowing free flow of fluid from beneath the piston 82 during a drive stroke. Intermediate positions of the choke 90 may be provided to allow intermediate conditions between full choke and no-choke positions.

In order to position the choke 90 in the different choke positions, the head portion 16 includes at least one cut out 92 defined therein (FIG. 1). A portion of the nose plate 94 extends partially into the cut out 92 defining at both ends of the cut out 92 a slight extension or shelf. The choke 90 includes at least one molded engagement member 96; however, in the preferred embodiment two such engagement portions 96 are illustrated. The extensions 96 in the non-choke position, such as in FIG. 2, are positioned between the extensions or shelves defined by the nose plate 94 allowing the choke 90 to be moved downwardly (FIG. 1). In the full choke position, the operator of the tool 10 grasps one or both of the extension portions 96 lifts upward, and rotates the plastic choke member 90 until the engagement portions 96 extend over the shelf defined by the edge of the nose plate 94. At this point, the choke member 90 may be released allowing the engagement portions 96 to rest on the shelf defined by the nose plate 94. In this position, the choke 90 is in the full choke position illustrated in FIG. 3.

Steps 93 may be provided at either side of the cut outs 92 and placement of the engagement portions 96 on individual steps will provide the intermediate positions of the choke 90. Other methods of providing intermediate choke positions may be recognized by one skilled in the art.

The choke 90 also may include an integral extension 98 that extends through an opening 99 defined in the front of the head portion so as to be grasped by the user of the tool 10 for placement of the choke 90 in the different positions if one of the extensions 96 cannot be grasped.

Through the employment of the choke member 90 in the above described manner, fastener penetration may be easily controlled by the operator of the tool 10 in accordance with the particular workpiece and job being performed.

While using the tool 10 for driving fasteners into an abrasive workpiece such as a shingle, the safety yoke 32 typically used in prior art tools is constructed of rigid wire or the like that wears rapidly, thus requiring frequent replacement and repair. In accordance with the principles of the present invention, the safety yoke 32 includes at least one, in the preferred embodiment two, wear block members 100 that are secured to the safety yoke assembly by screws 102 (FIG. 5). The wear block members 100 may be sintered carbide that are multi-sided and can be rotated to position different sides of the block 100 at a position extending below the safety yoke assembly 32 and lower end 48 of the nose portion 18 to engage the workpiece.

Consequently, since the wear blocks 100 are of a harder material than the material of the safety assembly 32, the blocks 100 wear out more slowly. Once one side of the wear blocks 100 eventually wears out, the blocks 100 may be rotated by loosening the screws 102 to position a new side extending below the safety assembly 32. It should also be noted as illustrated in FIG. 1 that even if the tool 10 is placed on a workpiece, the safety assembly 32 and the wear blocks 100 are positioned so that the sides of the wear blocks 100 extend slightly below the lower end 48 of the nose portion 18, thereby, serving to protect the lower end of the drive track and the nose portion 18.

Although the present invention has been described with reference to a particular embodiment thereof, it should be understood that numerous other modifications and embodiments can be devised by those skilled in the art that will fall within the spirit and scope of the principles of the present invention as claimed herein.

What is claimed and sought to be secured by Letters Patent of the United States is:

1. In a tool for driving fasteners comprising a housing defining a handle, a head portion and a nose portion, a cylinder movably mounted in said head portion, means in said tool for moving said cylinder within said head portion, a piston reciprocally mounted in said cylinder and a driver secured to said piston, means for driving said piston and said driver from a static mode through a fastener driving mode and for returning said piston and said driver at the completion of said fastener driving mode to said static mode, means for selectively operating said driving means, an annular member mounted in said head portion engaged by said cylinder during a static mode of said tool and at the completion of said fastener driving mode, said cylinder spaced from said annular member during said fastener driving mode, a driver power control system for controlling the penetration of fasteners into a workpiece comprising means for defining a passage from the interface of said cylinder and said annular member to a location at or near atmospheric pressure, a choke adjacent said annular member surrounding said cylinder manually movable from a position out of said passage means into a position for inhibiting fluid flow through said passage means and means on said housing to maintain said choke in said different positions.

2. The tool claimed in claim 1 wherein said choke comprises an annular element surrounding said cylinder and said annular member.

3. The tool claimed in claim 1 wherein said choke includes an engagement member and said means on said housing includes a holding portion for engaging said engagement member and holding said choke in an elevated position surrounding said interface in said position inhibiting fluid flow.

4. The tool claimed in claim 1 wherein said choke includes an engagement member and a slot in said housing in which said engagement member is positioned such that said choke is below said interface in said position out of said passage means.

5. The tool claimed in claim 1 further comprising a safety yoke cooperating with said selectively operating means for preventing actuation of said tool secured to said housing including a workpiece engagement portion extending below said nose portion comprising at least one wear block mounted on said workpiece engagement portion to engage a workpiece.

6. The tool claimed in claim 5 including means permitting said safety yoke to move relative to said nose portion upon placement of said tool on a workpiece with said wear block extending below said nose portion.

7. The tool claimed in claim 5 wherein said wear block includes multiple sides and means for allowing rotation of said wear block to place different sides on a workpiece.

8. An apparatus for controlling the driving of fasteners by a fluid actuated drive tool wherein said tool is of the type including a housing, a cylindrical sleeve movably mounted in said housing, a sleeve seal mounted in said housing and engaged by said sleeve during static and return modes of said tool and spaced from said seal during the drive mode, means for moving said sleeve into and out of engagement with said seal, a piston reciprocally mounted in said sleeve, a driver secured to said piston, means for driving said piston and driver through said drive mode, and for returning said piston and driver to said static mode, means for selectively operating said driving means, said apparatus comprising a control member, means for allowing manual positioning of said control member in either a first location at least partially encircling said sleeve spaced from said seal to allow fluid flow between said sleeve and said seal and a second location at least partially encircling said sleeve and said seal during said drive mode to inhibit by a predetermined amount the fluid flow therebetween.

9. The apparatus set forth in claim 8 wherein said control member comprises an annular member encircling said sleeve and said seal.

10. The system set forth in claim 8 wherein said tool further includes means for preventing actuation of said tool into said drive mode until said tool is placed on a workpiece, said preventing means including a work engaging member extending below said housing and mechanically connected to said selectively operating means and at least one wear member secured to said work engaging member.

11. A fastener driving tool including a choke for controlling the penetration of a fastener driven by said fastener driving tool into a workpiece, said tool including a housing, a sleeve reciprocally mounted in a said housing and movable from a first position to a second position defining a passage beneath said sleeve, a piston reciprocally mounted within said sleeve, a driver for engaging and driving fasteners wherein said driver is secured to said piston reciprocally mounted in said sleeve, means for driving said piston and driver from a static position through a driving stroke and for returning said piston and driver to said static position, means for selectively operating said driving means, means for elevating said sleeve during said driving stroke allowing fluid flow from beneath said piston out of said tool, said choke comprising an annular member mounted within said tool surrounding said sleeve to be manually movable to a first position below said sleeve to control the flow of fluid from beneath said piston through said passage during a fastener driving stroke of said tool and to a second position out of flow of said fluid, said tool including means for allowing access to said annular member, an engagement member on said annular member, and at least one holding portion on said tool on which said engagement member may be manually positioned to be held in said first or second position.

12. The tool claimed in claim 11 further comprising safety means mechanically coupled to said selectively operating means for preventing actuation of said tool until said tool is placed on a workpiece, said safety means including a workpiece engagement member, and a wear element secured to said workpiece engagement member extending below said tool.

13. The tool claimed in claim 12 wherein said wear member comprises at least more than one side and means for allowing said wear member to be selectively rotated on said workpiece engagement member to engage a selected side with said workpiece.

* * * * *